US008100357B2

(12) United States Patent
Tsai

(10) Patent No.: US 8,100,357 B2
(45) Date of Patent: Jan. 24, 2012

(54) METHOD AND STRUCTURE FOR CUTTING OFF WEB MATERIAL IN WINDING MACHINE

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 0 days.

(21) Appl. No.: 12/822,411

(22) Filed: Jun. 24, 2010

(65) Prior Publication Data

US 2010/0258670 A1 Oct. 14, 2010

Related U.S. Application Data

(63) Continuation-in-part of application No. 11/902,812, filed on Sep. 26, 2007.

(30) Foreign Application Priority Data

Jul. 27, 2007 (TW) ..... 96127668 A

(51) Int. Cl.
*B65H 19/26* (2006.01)
*B65H 19/28* (2006.01)
*B65H 35/08* (2006.01)
*B65H 20/16* (2006.01)

(52) U.S. Cl. ..... 242/532.2; 242/526; 242/542.3

(58) Field of Classification Search ..... 242/526.1, 242/532.2, 542, 542.2, 542.3, 521; 156/285, 156/510, 576; *B65H 19/26, 19/28, 35/08, B65H 20/16*

See application file for complete search history.

(56) References Cited

U.S. PATENT DOCUMENTS

| | | | | |
|---|---|---|---|---|
| 6,948,677 | B2 * | 9/2005 | Biagiotti et al. | 242/521 |
| 2004/0061021 | A1 * | 4/2004 | Butterworth | 242/521 |
| 2004/0256513 | A1 * | 12/2004 | Perini | 242/521 |
| 2006/0011767 | A1 * | 1/2006 | Biagiotti et al. | 242/526 |
| 2008/0224383 | A1 * | 9/2008 | Feygelman | 271/161 |

FOREIGN PATENT DOCUMENTS

WO WO 2005075328 A1 * 8/2005

* cited by examiner

*Primary Examiner* — Michael Mansen
*Assistant Examiner* — Stefan Kruer
(74) *Attorney, Agent, or Firm* — Rosenberg, Klein & Lee

(57) ABSTRACT

Disclosed are a method and a structure for cutting off web in a winding machine. The winding machine includes an upper winding roller having a circumferential surface close to and below which a cut-off mechanism is arranged. The cut-off mechanism includes a pivot shaft having an outer circumferential surface and at least one pinch arm having a connecting end mounted to the outer circumferential surface of the pivot shaft and a web engagement end extending outward from the outer circumferential surface of the pivot shaft and forming at least one suction opening. At least one cutting blade is provided on the web engagement end of the pinch arm at a location immediately by the suction opening. When the pinch arm is driven to rotate the web engagement end to an engagement position where the web engagement end opposes the upper winding roller, the suction opening of the web engagement end sucks and holds a web material passing therethrough, whereby the web material is subjected to a pulling force induced by a roll of paper formed in a winding nip and is thus stretched to have the cutting blade set in tight engagement with the web material to cut off the web material.

9 Claims, 8 Drawing Sheets

METHOD AND STRUCTURE FOR CUTTING OFF WEB MATERIAL IN WINDING MACHINE

REFERENCE TO RELATED APPLICATIONS

This Application is being filed as a Continuation-in-Part of patent application Ser. No. 11/902,812, filed 26 Sep. 2007, currently pending.

FIELD OF THE INVENTION

The present invention relates to cutting off web material, and in particular to a method and a structure for cutting off web material in a winding machine.

BACKGROUND OF THE INVENTION

A conventional winding machine comprises an upper winding roller, a guide plate, a lower winding roller, and a rider roller. The guide plate is arranged at a location close to and below a circumferential surface of the upper winding roller and forms a channel with the upper winding roller. The upper winding roller, the lower winding roller, and the rider roller form therebetween a winding nip.

A core around which a web material is wound to form a roll of paper is fed by a conveyor to a location beside the upper winding roller and is then pushed by a core inserter into a passage delimited by the guide plate to reach the winding nip where the web material is wound around the core to form the roll of paper, such as a roll of toilet tissue. After completion of the winding operation of a roll of paper, a rotatable arm is controlled to have a speed that is faster or slower than the rotational speed of the upper winding roller in order to induce a speed difference by which the web material is torn and thus separated.

Another known technique uses a method and a structure that realizes separation of web material with physical engagement. For example, a driving arm is positioned against a surface of an upper winding roller arranged in a winding machine to hold down a web material passing through the surface of the upper winding roller. The web material is then torn and thus separated by a pulling force induced by a roll of paper that is formed in a winding nip by wounding the paper around a core.

SUMMARY OF THE INVENTION

However, in the above discussed conventional winding machine, care must be taken for the rotatable arm to rotate at a speed not equal to that of an upper winding roller in order to pull apart the web material through a difference in speed. In case the web material is made of a tough material, the speed difference between the rotatable arm and the upper winding roller must be sufficiently large, otherwise the web material would not be pulled apart by the speed difference. In a known winding machine, a perforation device is often provided at a location before a web material reaches a winding channel to form perforation in the web material in advance, so that the web material can be torn or broken at a predetermined location when the web material goes through a subsequent winding process. This complicates the structure of the winding machine.

In the known web material separation technique that employs physical engagement, the driving arm must be positioned to physically contact the surface of the upper winding roller. This causes certain concerns about durability and operation safety of the components and parts of the machine.

Thus, an objective of the present invention is to provide a web material winding machine comprising a cut-off mechanism that cuts off a web material by employing a cutting blade together with a pinch arm.

Another objective of the present invention is to provide a winding machine that comprises an evacuation device and a cut-off mechanism comprising a suction channel and a passage.

A further objective of the present invention is to provide a method and a device for cutting off web material in a winding machine that employs a vacuum suction force that cooperates with a cutting blade to cut off the web material.

The solution adopted in the present invention to overcome the problems of the conventional techniques comprises a winding machine that comprises an upper winding roller having a circumferential surface close to and below which a cut-off mechanism is arranged. The cut-off mechanism comprises a pivot shaft having an outer circumferential surface and at least one pinch arm having a connecting end and a web engagement end. The connecting end is mounted to the outer circumferential surface of the pivot shaft. The web engagement end extends outward from the outer circumferential surface of the pivot shaft and forms at least one suction opening. At least one cutting blade is provided on the web engagement end of the pinch arm at a location immediately by the suction opening. When the pinch arm is driven to rotate the web engagement end of the pinch arm to an engagement position where the web engagement end opposes the upper winding roller, the suction opening of the web engagement end sucks and holds a web material passing therethrough, whereby the web material is subjected to a pulling force induced by a roll of paper formed in a winding nip and is thus stretched to have the cutting blade set in tight engagement with the web material to cut off the web material.

With the solution provided by the present invention, a cutting blade is adopted to work with a pinch arm and a suction opening formed in a web engagement of the pinch arm, whereby the suction opening of the web engagement end sucks and holds a web material passing therethrough when the pinch arm is driven to rotate the web engagement end to an engagement position where the web engagement end opposes an upper winding roller, so as to subject a web material that is being wound and forms a roll of paper in a winding nip to a pulling force induced by the roll of paper in the winding nip and thus stretch the web material with which the cutting blade is set in tight engagement with the web material to cut off the web material. The cutting process can be performed in a smooth and reliable manner and the web material shows improved regularity at the location where cutting is made.

In respect of the structural arrangement of the whole winding machine, since the cutting blade is provided to precisely and reliably cut off the web material at a predetermined location, it no longer needs to provide a perforation device that is adopted in the conventional machines, whereby the structure of the winding machine can be simplified.

Further, at the time when the web material is to be cut off by the cutting blade, the web material is sucked and securely held by the suction opening formed in the web engagement end of the pinch arm and the web material is properly stretched by a pulling force induced by a paper roll that is being formed in a winding nip so as to allow the cutting blade to be set in tight engagement with the web material to cut off the web material. In the process, no physical engagement is formed between the cutting blade and a circumferential surface of the upper winding roller, so that durability and operation safety of the components and parts of the machine can be improved.

BRIEF DESCRIPTION OF THE DRAWINGS

The present invention will be apparent to those skilled in the art by reading the following description of preferred embodiments of the present invention and the best modes for carrying out the present invention, with reference to the attached drawings, in which.

DETAILED DESCRIPTION OF THE PREFERRED EMBODIMENTS

Figure 1:
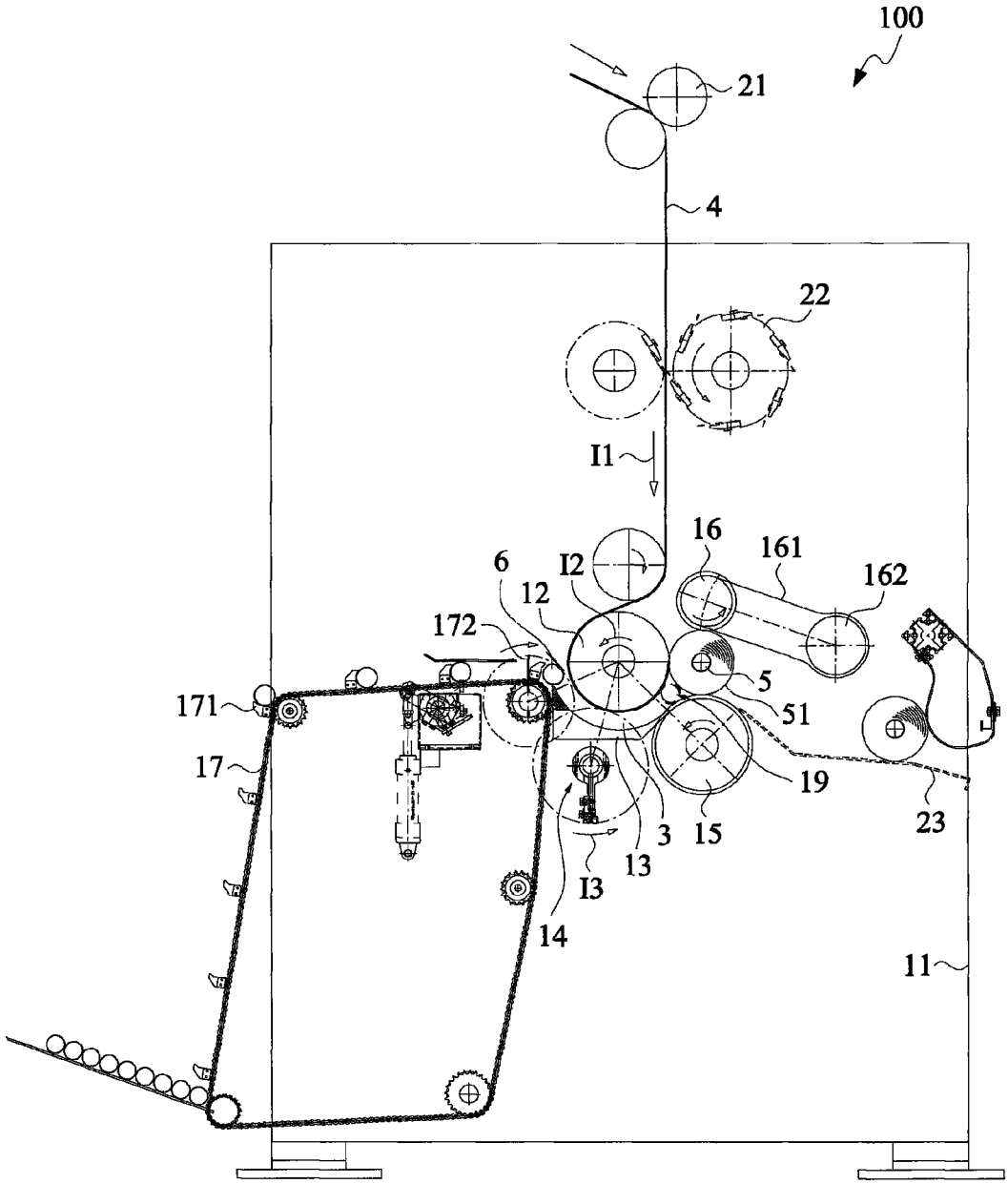
FIG. 1 is a schematic side view showing a winding machine in accordance with an embodiment of the present invention.

With reference to the drawings and in particular to FIG. 1, a winding machine constructed in accordance with a first embodiment of the present invention, broadly designated at 100, comprises a machine frame 11, an upper winding roller 12, a plurality of guide plates 13 (only one being visible in a schematic side view shown in FIG. 1), a cut-off mechanism 14, a lower winding roller 15, a rider roller 16, a core conveyor 17, a pair of feed rollers 21, and an inclined chute 23.

The guide plates 13 are located at positions close to and below the upper winding roller 12 such that a channel 3 is formed between the guide plates 13 and the upper winding roller 12. A winding nip 19 is formed between the upper winding roller 12, the lower winding roller 15, and the rider roller 16. A long tape of web material 4 that has a predetermined thickness and width is fed forward in a feeding direction I1 by the feed rollers 21 to be then positioned against a lower circumferential surface of the upper winding roller 12 and wound around a first core 5 in the winding nip 19 to thereby form a roll of paper 51 having a predetermined diameter, such as a roll of toilet paper, in the winding nip 19.

Figure 2:
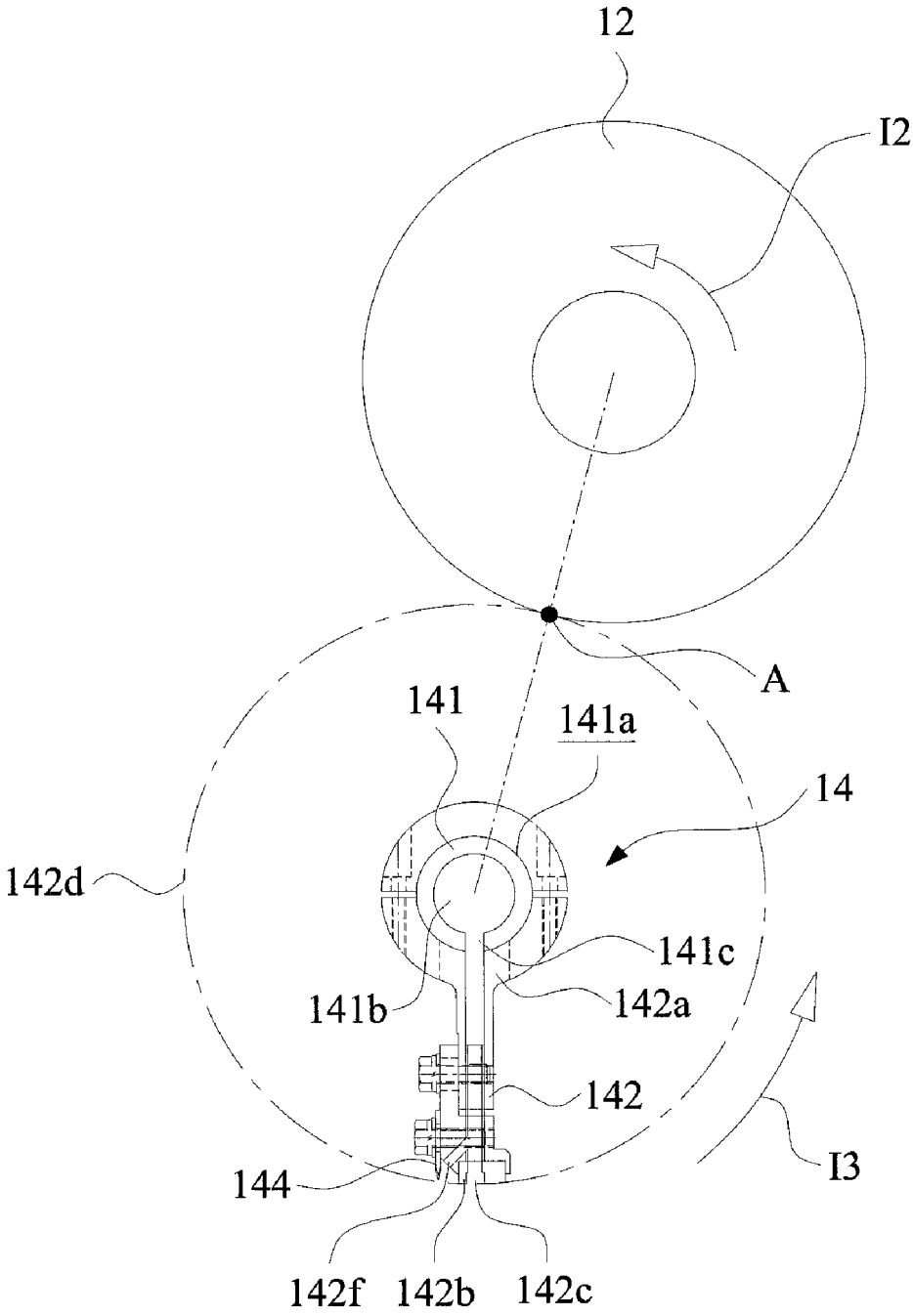
FIG. 2 is a schematic side view showing an upper winding roller and a cut-off mechanism of the winding machine in accordance with the present invention.

Referring to FIG. 2, the cut-off mechanism 14 is arranged close to and below the upper winding roller 12. The cut-off mechanism 14 comprises a pivot shaft 141 and at least one pinch arm 142. The pivot shaft 14 comprises an outer circumferential surface 141*a* and the pivot shaft 141 is coupled to the machine frame 11. The pinch arm 142 is coupled to the outer circumferential surface 141*a* of the pivot shaft 141. The pinch arm 142 has a connecting end 142*a* and a web engagement end 142*b*. The connecting end 142*a* is fixedly mounted to the outer circumferential surface 141*a* of the pivot shaft 141, and the web engagement end 142*b* extends outward from the outer circumferential surface 141*a* of the pivot shaft 141.

A driving mechanism (not shown) drives the pinch arm 142 to rotate about the pivot shaft 141. The pinch arm 142 is rotatable in a rotation direction I3 that is the same as a rotation direction I2 of the upper winding roller 12 so that the web engagement end 142*b* of the pinch arm 142, when rotated to reach an engagement position A, is moved in a direction opposite to the rotation direction I2 of the upper winding roller 12. The rotation of the pinch arm 142 defines a circular rotation locus 142*d*.

Figure 3:
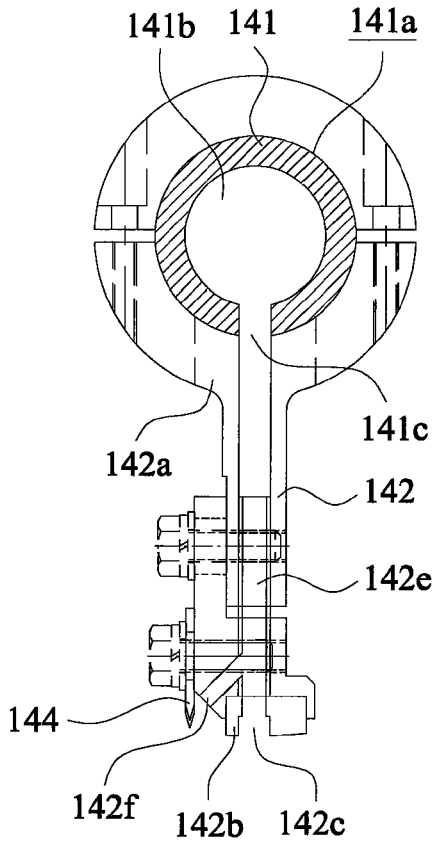
FIG. 3 is a cross-sectional view showing a pinch arm of the cut-off mechanism according to the present invention.
Figure 4:
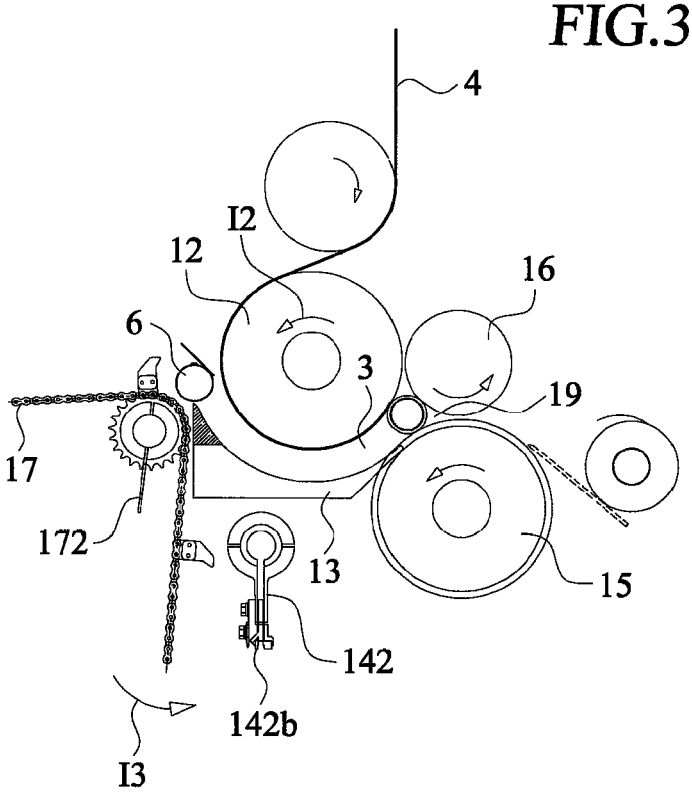
FIG. 4 is a schematic side view showing a first view of cutting off web material.

Also referring to FIG. 3, the web engagement end 142*b* of the pinch arm 142 forms a suction opening 142*c*. The pivot shaft 141 is a hollow tube forming internally a suction channel 141*b*. The pivot shaft 141 forms a plurality of apertures 141*c* in the outer circumferential surface 141*a* at predetermined positions to communicate the suction channel 141*b*. The pinch arm 142 forms internally at least one passage 142*e* communicating the suction opening 142*c* and the apertures 141*c* of the pivot shaft 141. An evacuation device (not shown) is connected to the pivot shaft 141 to remove air from the suction channel 141*b* of the pivot shaft 141 and the passage 142*e* of the pinch arm 142, so that the web engagement end 142*b* of the pinch arm 142 may establish a vacuum suction force at the suction opening 142*c*. Preferably, the suction opening 142*c* of the web engagement end 142*b* shows a recessed structure so that an excellent suction effect can be realized by the suction opening 142*c* to attract and hold the web material 4.

The web engagement end 142*b* of the pinch arm 142 is provided with at least one cutting blade 144 (see both FIGS. 2 and 3) at the side thereof opposite to the rotation direction I3 of the pinch arm 142 at a location immediately close thereto. The cutting blade 144 projects by such a distance to substantially correspond to the circular rotation locus 142*d* of the pinch arm 142.

Further, in addition to the suction opening 142*c*, the web engagement end 142*b* of the pinch arm 142 forms a secondary suction opening 142*f* between the suction opening 142*c* and the cutting blade 144. The secondary suction opening 142*f* is also in communication with the passage 142*e*. Preferably, the secondary suction opening 142*f* is formed at a location that is slightly lower than the projection distance of the cutting blade 144 if reference is taken to the circular rotation locus 142*d*.

Figure 5:
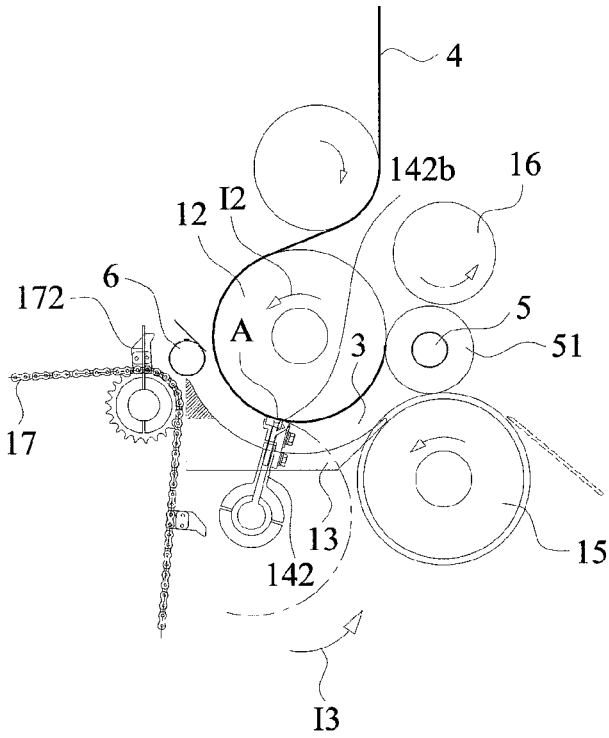
FIG. 5 is a schematic side view showing a second view of cutting off web material.

Referring to FIGS. 4-12, a sequence of operations are performed by the embodiment of the present invention to cut off the web material. When the pinch arm 142 is driven by the driving mechanism 143 to rotate in the rotation direction I3, the web engagement end 142*b* of the pinch arm 142 is periodically rotated to reach the engagement position A where the web engagement end 142*b* of the pinch arm 142 opposes the upper winding roller 12 (as shown in FIG. 5). At this moment, the web engagement end 142*b* of the pinch arm 142 is set in engagement with the web material 4, and the web engagement end 142*b* of the pinch arm 142 sucks and holds the web material 4 on the suction opening 142*c*.

As shown in FIG. 5, when the web engagement end 142*b* of the pinch arm 142 is rotated to the engagement position A, the web engagement end 142*b* of the pinch arm 142 sucks and holds the web material 4 and positions an upper surface of the web material 4 tightly against the lower circumferential surface of the upper winding roller 12. In another embodiment of the present invention, the web engagement end 142*b* of the pinch arm 142, when located at the engagement position A, sucks and holds the web material 4 but is spaced from the upper winding roller 12 by a predetermined distance, so that the web material 4 is not in physical engagement with the lower circumferential surface of the upper winding roller 12.

A second core 6 is carried forward by one of a number of carriers 171 of the core conveyor 17 to a loading nip of the channel 3 between the guide plates 13 and the upper winding roller 12. Afterwards, a core inserter 172 of the core conveyor 17 turns to push the second core 6 into the channel 3 (as shown in FIG. 6).

Figure 6:
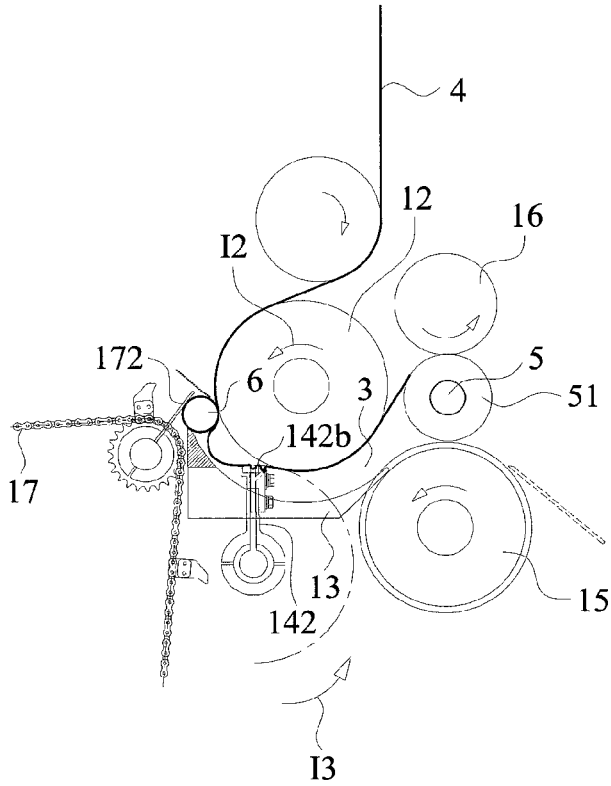
FIG. 6 is a schematic side view showing a third view of cutting off web material.

Subsequently after the web material 4 is sucked and held by the suction opening 142*c* of the web engagement end 142*b* of the pinch arm 142, a portion of the web material 4 at an adjacent location is sucked and held by the secondary suction opening 142*f*, whereby the web material 4 is set in a configuration comprising bends (as shown in FIG. 6) and the lower surface of the web material 4 is sucked and securely held by the web engagement end 142*b* of the pinch arm 142.

Figure 7:
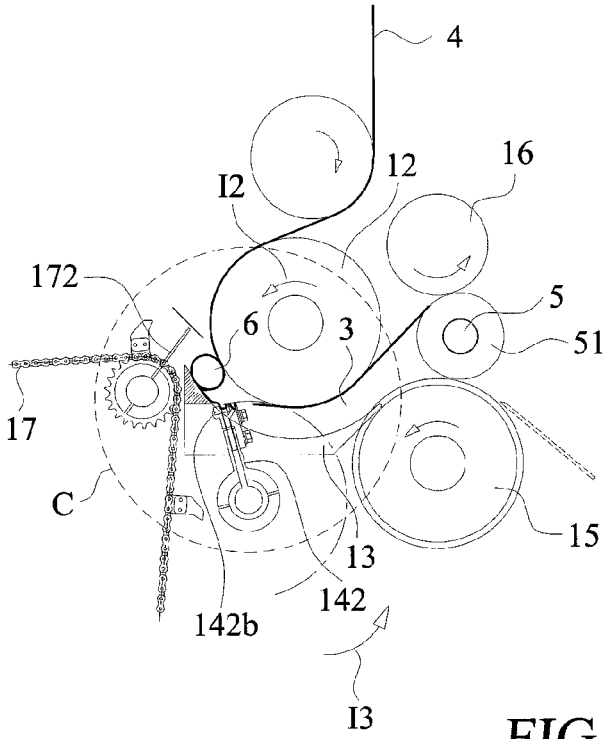
FIG. 7 is a schematic side view showing a fourth view of cutting off web material.
Figure 8:
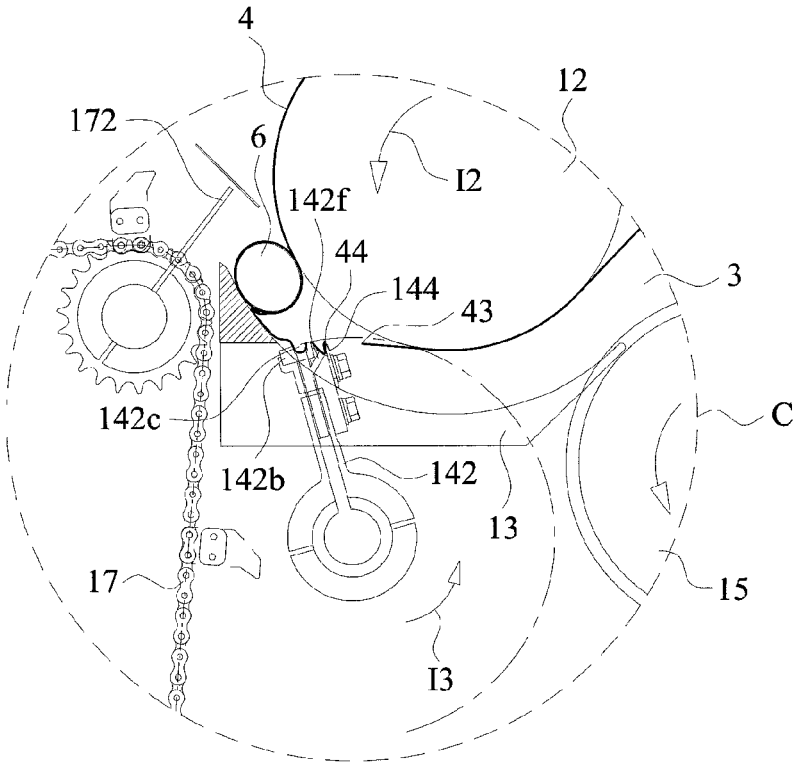
FIG. 8 is an enlarged view of the circled portion C of FIG. 7.
Figure 9:
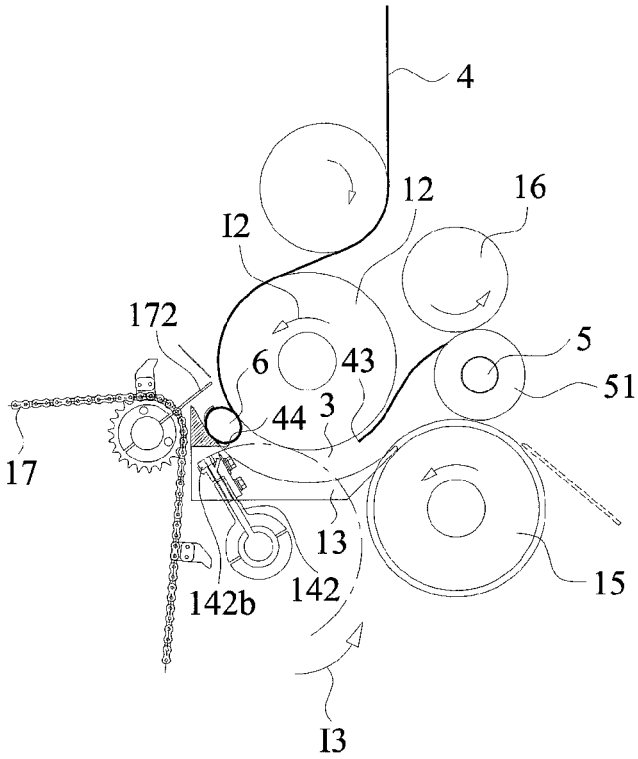
FIG. 9 is a schematic side view showing a fifth view of cutting off web material.
Figure 10:
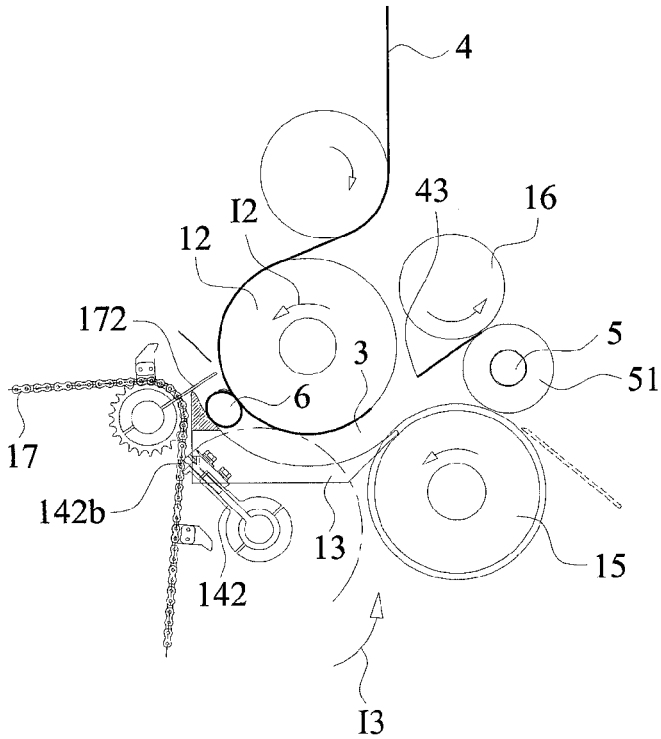
FIG. 10 is a schematic side view showing a sixth view of cutting off web material.

With the pinch arm 142 being rotated by an angle in the rotation direction l3, the paper roll 51 that is formed by being rolled up in the winding nip 19 applies a pulling force to a right-hand side portion of the web material 4 so as to stretch the web material 4 and the cutting blade 144 provided on the pinch arm 142 is put in tight engagement with the web material 4 and thus cuts off the web material 4 (as shown in FIGS. 7 and 8), whereby the web material 4 that is so cut off forms, at the location where the cutting occurs, a trailing edge 43 in connection with the first core 5 and a leading edge 44 in connection with the second core 6. The trailing edge 43 of the web material 4 keeps moving toward and is then wound around the first core 5 to complete the winding operation of the paper roll 51.

When the web material 4 is cut off, the web engagement end 142*b* of the pinch arm 142 is caused by the evacuation device to suck and hold the leading edge 44 of the web material 4 and the pinch arm 142 that is caused to rotate in a direction opposite to the web material at the engagement position A brings the leading edge 44 of the web material 4 toward the second core 6 that is just fed into the channel 3, to allow the leading edge 44 of the web material 4 to be primarily wound around an outer circumferential surface of the second core 6 (as shown in FIGS. 7-10).

Figure 11:
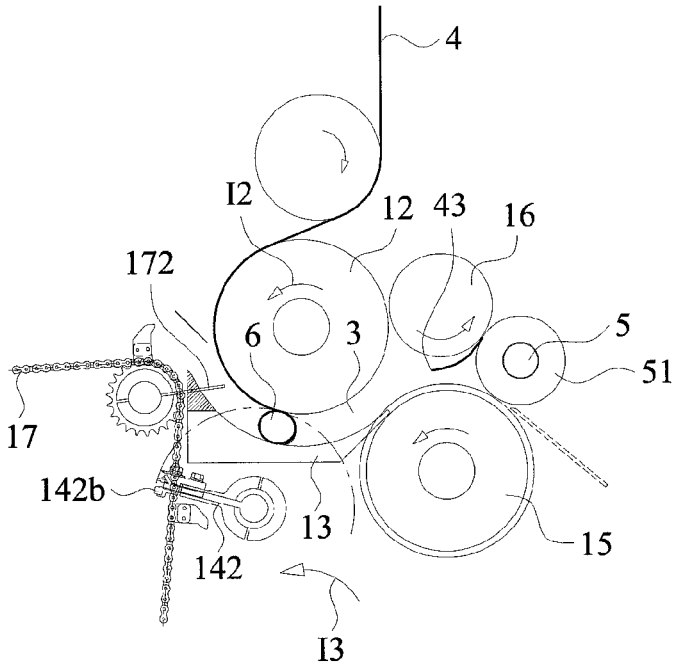
FIG. 11 is a schematic side view showing a seventh view of cutting off web material.
Figure 12:
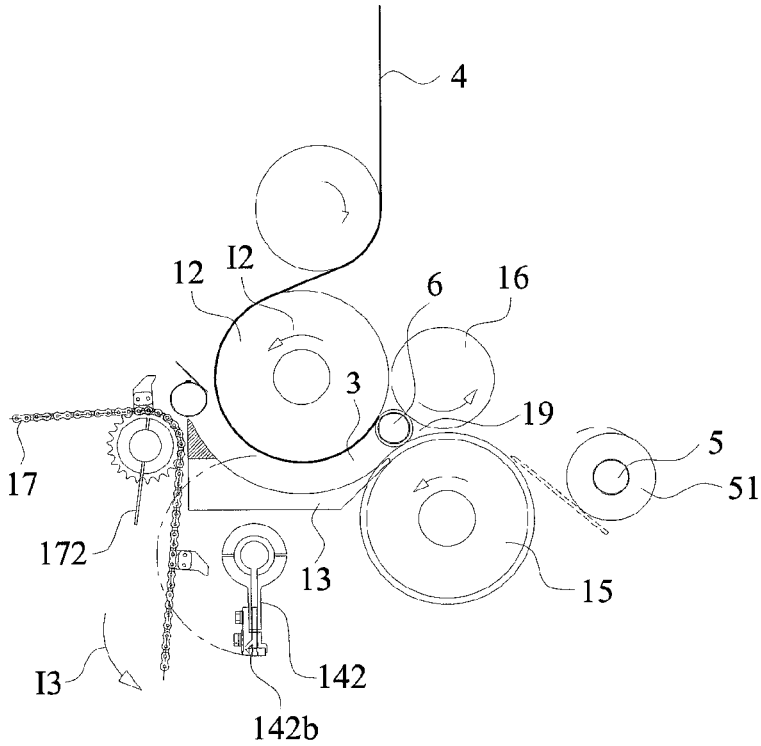
FIG. 12 is a schematic side view showing an eighth view of cutting off web material.

When the pinch arm 142 is rotated to such an extent to get away from the web material 4 and the channel 3, the second core 6 keeps on rolling forward along the channel 3, and the leading edge 44 of the web material 4 is completely wound around the second core 6. Meanwhile, the trailing edge 43 of the web material 4 is attached to the paper roll 51 to complete the winding operation of the roll paper 51 (as shown in FIGS. 11 and 12).

The second core 6 is transferred to the winding nip 19 due to an effect of speed difference between the upper winding roller 12 and the lower winding roller 15 caused by speed reduction of the lower winding roller 15 (see FIG. 12) and then the winding operation of a new roll of paper starts. Meanwhile, the completed paper roll 51 is discharged by moving along the inclined chute 23.

When the paper roll 51 is being discharged through the inclined chute 23, the rider roller 16 that is connected to a rocker arm 161 having a rotation shaft 162 about which the rocker arm 161 reciprocally rotates is allowed to do reciprocal rotation about the rotation shaft 162, whereby the rider roller 16 that is connected to the rocker arm 161 is moved upward and downward, following the reciprocation path of the rocker arm 161. Thus, when the paper roll 51 has been discharged, the rider roller 16 that initially presses against the paper roll 51 moves downward to press against the second core 6.

Figure 13:
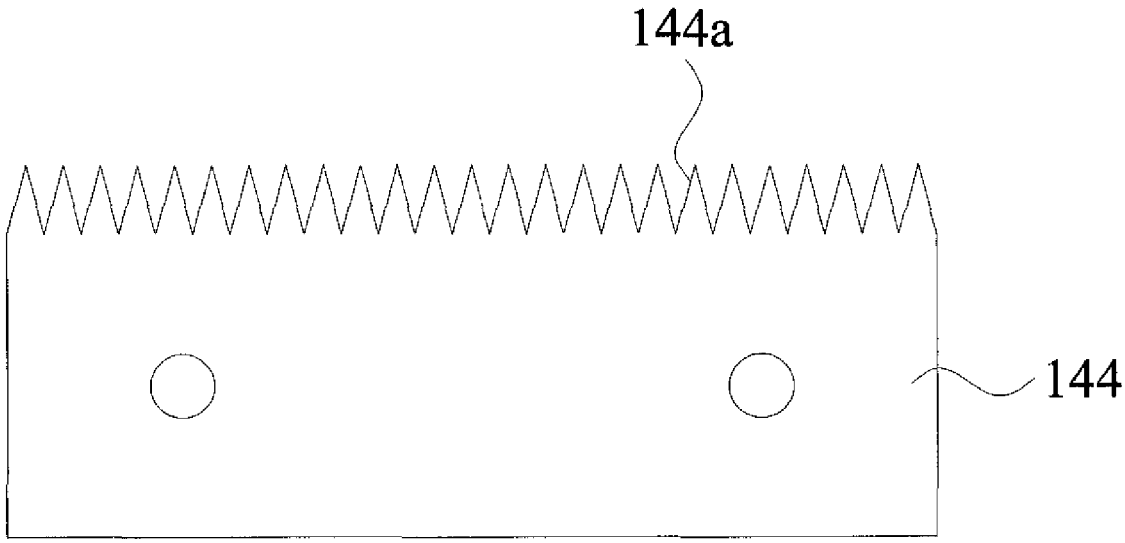
FIG. 13 is a schematic view showing a cutting blade having a cutting edge of a serrated structure adopted in the present invention.

In the above arrangement, the cutting blade 144 is the element that actually performs the cut-off operation. The cutting blade 144 has a cutting edge 144*a* that can be a flat and straight edge or it can alternatively be of a serrated structure (see FIG. 13) to facilitate cutting the web material 4 off.

In the previous description, the present invention has been explained with reference to the preferred embodiments thereof and the best modes for carrying out the present invention. And, it is apparent to those having ordinary skills in the art and related fields that a variety of modifications and changes may be made without departing from the scope of the present invention which is intended to be defined by the appended claims.

What is claimed is:

1. A method for cutting off web material in a winding machine, which comprises an upper winding roller, at least one guide plate, a lower winding roller, and a rider roller, wherein the guide plate is arranged at a location close to and below the upper winding roller and forms a channel with the upper winding roller, the upper winding roller, the lower winding roller, and the rider roller forming therebetween a winding nip, a cut-off mechanism being arranged below the upper winding roller and comprising a pivot shaft and a pinch arm extending from the pivot shaft, the pinch arm having a web engagement end that forms at least one suction opening, the web engagement end of the pinch arm comprising at least one cutting blade set immediately by the suction opening, the method comprising the following steps:

(a) having a web material borne on a lower circumferential surface of the upper winding roller that is rotatable in a predetermined rotation direction to have the web material fed into and pass through the channel;

(b) winding the web material which passes through the channel around a first core in the winding nip to form a paper roll;

(c) driving the pinch arm to rotate in a rotation direction that is identical to rotation direction of the upper winding roller so as to have the web engagement end periodically reaching an engagement position where the web engagement end opposes the upper winding roller, the web engagement end of the pinch arm being engageable with the web material at the engagement position, the web engagement end of the pinch arm being moved in a direction opposite to the upper winding roller at the engagement position;

(d) causing the suction opening to suck and hold the web material that passes through the channel at the time when the web engagement end of the pinch arm is at the engagement position; and (e) subjecting the web material to a pulling force induced by the paper roll that is formed in the winding nip so as to stretch the web material to allow the cutting blade to be set in tight engagement with the web material and thus cutting off the web material;

wherein the web engagement end of the pinch arm forms a secondary suction opening between the suction opening and the cutting blade and wherein in step (d), the secondary suction opening and the suction opening of the web engagement end of the pinch arm suck and hold the web material substantially at the same time when the web engagement end is at the engagement position.

2. The method for cutting off web material in a winding machine as claimed in claim 1, wherein in step (c), the web engagement end of the pinch arm engages and tightly positions the web material against the lower circumferential surface of the upper winding roller.

3. A structure for cutting off web material in a winding machine, the web material winding machine comprising an upper winding roller, at least one guide plate, a lower winding roller, and a rider roller, wherein the guide plate is arranged at a location close to and below the upper winding roller and forms a channel with the upper winding roller, the upper winding roller, the lower winding roller, and the rider roller forming therebetween a winding nip, a web material being fed into and passing through the channel to form a paper roll in the winding nip by being wound around a first core, a cut-off mechanism being arranged at a location close to and below the upper winding roller, the cut-off mechanism comprising:

a pivot shaft, which has an outer circumferential surface;

at least one pinch arm, which is coupled to the outer circumferential surface of the pivot shaft, the pinch arm having a connecting end and a web engagement end, the connecting end being mounted to the outer circumferential surface of the pivot shaft, the web engagement end extending outward from the outer circumferential surface of the pivot shaft and forming at least one suction opening;

a driving mechanism, which is connected to the pivot shaft to drive the pinch arm to rotate about the pivot shaft so as to have the web engagement end of the pinch arm moving along a circular rotation locus for being periodically set on an engagement position or off the engagement position, the web engagement end of the pinch arm being engageable with the web material at the engagement position;

at least one cutting blade, which is provided on the web engagement end of the pinch arm at a location immediately by the suction opening;

a suction channel, which is formed inside the pivot shaft and communicates the suction opening of the web engagement end through a passage; and an evacuation device, which is connected to the pivot shaft and communicates the suction channel to form a vacuum suction force at the suction opening of the web engagement end of the pinch arm;

wherein when the pinch arm is driven by the driving mechanism to have the web engagement end of the pinch arm reaching the engagement position, the suction opening of the web engagement end of the pinch arm sucks and holds the web material passing through the channel, whereby the web material is subjected to a pulling force induced by the paper roll formed in the winding nip and thus stretched to allow the cutting blade to be set in tight engagement with the web material to thereby cut off the web material; and wherein the web engagement end of the pinch arm forms a secondary suction opening between the suction opening and the cutting blade and the secondary suction opening and the suction opening of the web engagement end of the pinch arm suck and hold the web material substantially at the same time when the web engagement end is at the engagement position.

4. The structure for cutting off web material in a winding machine as claimed in claim 3, wherein the secondary suction opening is in communication with the passage.

5. The structure for cutting off web material in a winding machine as claimed in claim 4, wherein the secondary suction opening is formed at a location that is slightly lower than the circular rotation locus of the pinch arm.

6. The structure for cutting web material in a winding machine as claimed in claim 3, wherein the web engagement end of the pinch arm is moved in a rotational direction opposite to the rotational direction of the upper winding roller when the web engagement end reaches the engagement position.

7. The structure for cutting off web material in a winding machine as claimed in claim 3, wherein the cutting blade projects by a distance to substantially correspond to the circular rotation locus of the pinch arm.

8. The structure for cutting off web material in a winding machine as claimed in claim 3, wherein the web engagement end of the pinch arm tightly positions the web material against the upper winding roller when reaching the engagement position.

9. The structure for cutting off web material in a web material winding machine as claimed in claim 3, wherein the cutting blade has a cutting edge having a serrated structure.

* * * * *